United States Patent [19]

Hänsel et al.

[11] 4,352,265

[45] Oct. 5, 1982

[54] APPARATUS FOR PRODUCING BAR PACKAGES OF PREFERABLY INDIVIDUALLY WRAPPED SWEETS OR SIMILAR PIECES OF CONFECTIONERY

[75] Inventors: Otto Hänsel, Hanover; Hans Lesch; Hans-Bernd Lesch, both of Germisch-Partenkirchen, all of Fed. Rep. of Germany

[73] Assignee: Otto Hänsel GmbH, Hanover, Fed. Rep. of Germany

[21] Appl. No.: 84,807

[22] Filed: Oct. 15, 1979

[51] Int. Cl.[3] ..... B65B 35/52

[52] U.S. Cl. ..... 53/541; 53/171; 53/234; 414/46; 414/93

[58] Field of Search ..... 53/170, 225, 234, 227, 53/541, 171, 496; 414/46, 92, 93; 198/624, 480

[56] References Cited

U.S. PATENT DOCUMENTS

| | | | |
|---|---|---|---|
| 150,549 | 5/1874 | Ewing | 53/234 X |
| 413,589 | 10/1889 | White | 198/624 X |
| 1,320,699 | 11/1919 | Levmann | 53/547 |
| 1,572,257 | 2/1926 | Van Buren | 53/171 |
| 2,276,744 | 3/1942 | Smith | 53/133 X |
| 2,589,886 | 3/1952 | Spinney | 53/542 X |
| 3,507,088 | 4/1970 | Mizelle | 53/496 X |
| 3,818,675 | 6/1974 | Griner | 53/233 X |
| 3,899,865 | 8/1975 | Revaz | 53/234 |
| 4,006,577 | 2/1977 | Schopee | 53/234 X |
| 4,056,199 | 11/1977 | Schoppee | 53/541 X |

*Primary Examiner*—John Sipos
*Attorney, Agent, or Firm*—Max Fogiel

[57] ABSTRACT

The invention relates to an apparatus for producing bar packages from individually wrapped sweets. The apparatus comprises a sweets holder extending into the path of movement of the sweet grippers of the packing head and revolving continuously at the same speed as the packing head, a stack former with bar packing means adjacent thereto and transfer means disposed between sweets holder and stack former and which forms from the individually wrapped sweets which are fed continuously and one after another to the sweets holder a rod of sweets in the stack former, the rod or bar of sweets then being enclosed in an outer wrapper in the bar packing apparatus. The sweets holder comprises two discs rotating continuously about a common axis and gripping the sweets between then which are pressed towards each other axially by springs and which have on the periphery of their facing sides outwardly open recesses which form the chambers which hold the sweets, the radial depth of the chambers corresponding to the thickness of the sweets and the chamber bottom gradually, against the direction of revolution of the discs, merging into the outer periphery of the discs, a stationary stop being provided which engages between the two discs and which, as the discs rotate, transfers the sweets held between the discs away radially outwardly over the rising chamber floor and into the stack former.

7 Claims, 10 Drawing Figures

APPARATUS FOR PRODUCING BAR PACKAGES OF PREFERABLY INDIVIDUALLY WRAPPED SWEETS OR SIMILAR PIECES OF CONFECTIONERY

The invention relates to an apparatus for producing bar packages from preferably individually wrapped sweets or similar pieces of confectionery. German Pat. No. 2,329,534 (same as U.S. Pat. No. 3,899,865) has already discussed packing apparatuses having, mounted on a continuously revolving packing head, sweet grippers and folding means which wrap individually and serially in wrapper blanks the sweets which are supplied by a charging apparatus. The result is individually wrapped sweets which then later have to be placed into collective packages, packing wrappers or the like. Hitherto, this operation has been found to be time-consuming and labour-intensive. Special sorting equipment and packaging machines and a large number of operatives had to be used.

The object of the invention is to provide an apparatus which makes it possible to produce, fully automatically and in a continuous working process, what are known as bar packages from the individually wrapped sweets, in each case a predetermined number of individual packed pieces are stacked and introduced jointly into a suitable collective packing wrapper.

According to the invention, this is achieved in that a plant for producing collective packages is connected to the packing head. This is characterized by a sweets holder extending into the path of movement of the sweet grippers of the packing head and revolving continuously at the same speed as the packing head and provided on its periphery with chambers to hold the sweets, a stack former with bar packing means adjacent thereto and transfer means disposed between sweets holder and stack former and which forms from the individually wrapped sweets which are fed continuously and one after another to the sweets holder a rod of sweets in the stack former, the rod or bar of sweets then being enclosed in an outer wrapper in the bar packing apparatus.

Preferably, the sweets holder comprises two discs rotating continuously about a common axis and gripping the sweets between them which are pressed towards each other axially by springs and which have on the periphery of their facing sides outwardly open recesses which form the chambers which hold the sweets, the radial depth of the chambers corresponding to the thickness of the sweets and the chamber bottom gradually, against the direction of revolution of the discs, merging into the outer periphery of the discs, a stationary stop being provided which engages between the two discs and which, as the discs rotate, transfers the sweets held between the discs away radially outwardly over the rising chamber floor and into the stack former.

On the other hand, the stack former is constituted by a stacking shaft which receives the sweets one after another and which is adjacent to and more or less radially spaced apart from the sweets holder, its capacity being adjustable to suit the number of sweets or dimensions of sweets to be packed in a bar and being connected to a conveyor means leading to the bar packing apparatus. The conveyor means may extend transversally of the stacking shaft or even in the longitudinal direction thereof, the bar packing apparatus being constructed either as a tube packaging machine which wraps the bar of sweets in a continuous tube of wrapping material or as a folding packaging machine which places and folds a prepared blank of wrapping material around the bar of sweets.

Further details of the apparatus according to the invention are explained in the ensuing description and in the Patent Claims, with reference to the accompanying drawings, in which:

Figure 1:
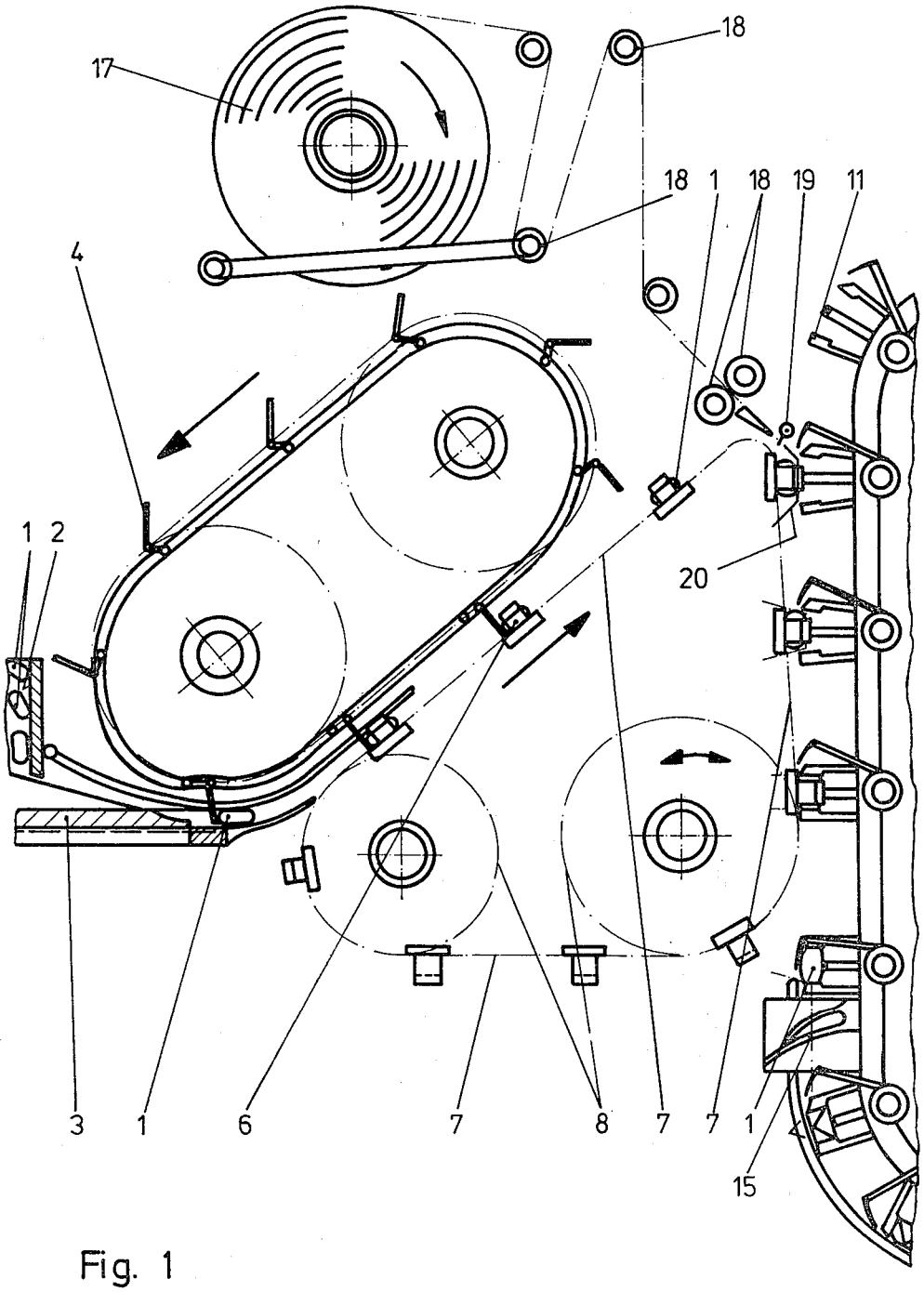
FIG. 1 shows a diagrammatic view of a conventional sweet wrapping machine, such as corresponds more or less to German Federal Pat. No. 2,329,534.

The sweets 1, which have to be individually wrapped, are introduced into the fitment 2 on the revolving charging plate 3 and are withdrawn from this individually and one after another by the drivers 4 of a withdrawing device 5 rotating in the direction of the arrow and are transferred to sweets holders 6 mounted on a conveyor chain 7 which runs around guide pulleys 8. From the holders 6, the not yet wrapped sweets 1 pass to the packing head, in which the individual sweets are wrapped in a suitable wrapping material.

The packing head consists substantially of a conveyor chain revolving in a closed path and guided by guide members not shown in greater detail. Mounted on the conveyor chain 9 and cooperating sweets grippers 11, 12 with a spring-loaded pressing member 13 disposed between them and with folding members 14. In addition, fixed folding cams 15 and guides 16 are provided, by means of which the sweet 1 is in known manner enclosed in a wrapper blank. The wrapping material runs from a supply roll 17 over tensioning and guide members 18 and a cutter 19 to the place where the sweets holders 6 enter the range of the sweets grippers 11, 12 of the packing head.

Control devices, not shown in greater detail, are provided for controlling the sweets grippers and folding members. In any case, a wrapper blank 20 is, by means of the packing head, placed around the bare sweets 1 and properly folded or even provided with a sealing twist. The individually wrapped sweets 10 now pass out of the packing head or out of the sweet grippers 11, 12 provided thereon and into the apparatus according to the invention for producing a bar package from an appropriately fixed number of individually wrapped sweets 10.

The apparatus according to the invention consists essentially of a sweets holder A, a stack former B and a bar packing apparatus C, as indicated in FIGS. 7 or 8 to 10.

The sweets holder A consists of two axially displaceable discs 23 rotating with a common drive spindle 22 which are supported via oppositely acting springs 24 so on abutments 25 mounted on the spindle 22 that they seek to press resiliently against each other. A free space 26 always remains between the two discs 23 so that the discs 23 have sufficient clearance to grip the already individually wrapped sweets 10 between them and hold them fast under the action of the springs 23.

On their facing sides the discs 23 have, on their outer periphery, recesses 27 bounded on one side by a wall 28 and on the other by a bottom surface 29 which merges into the outer periphery of the discs 23. The recesses provided in each disc 23 and bounded by the faces 27, 28 and 29 form jointly on the periphery of the two discs 23 successive chambers to hold the sweets, the said chambers widening out slightly towards the outer edge so that the sweets can be removed from the packing head without difficulty and gripped between the discs 23 which are reciprocally sprung.

Figure 2:
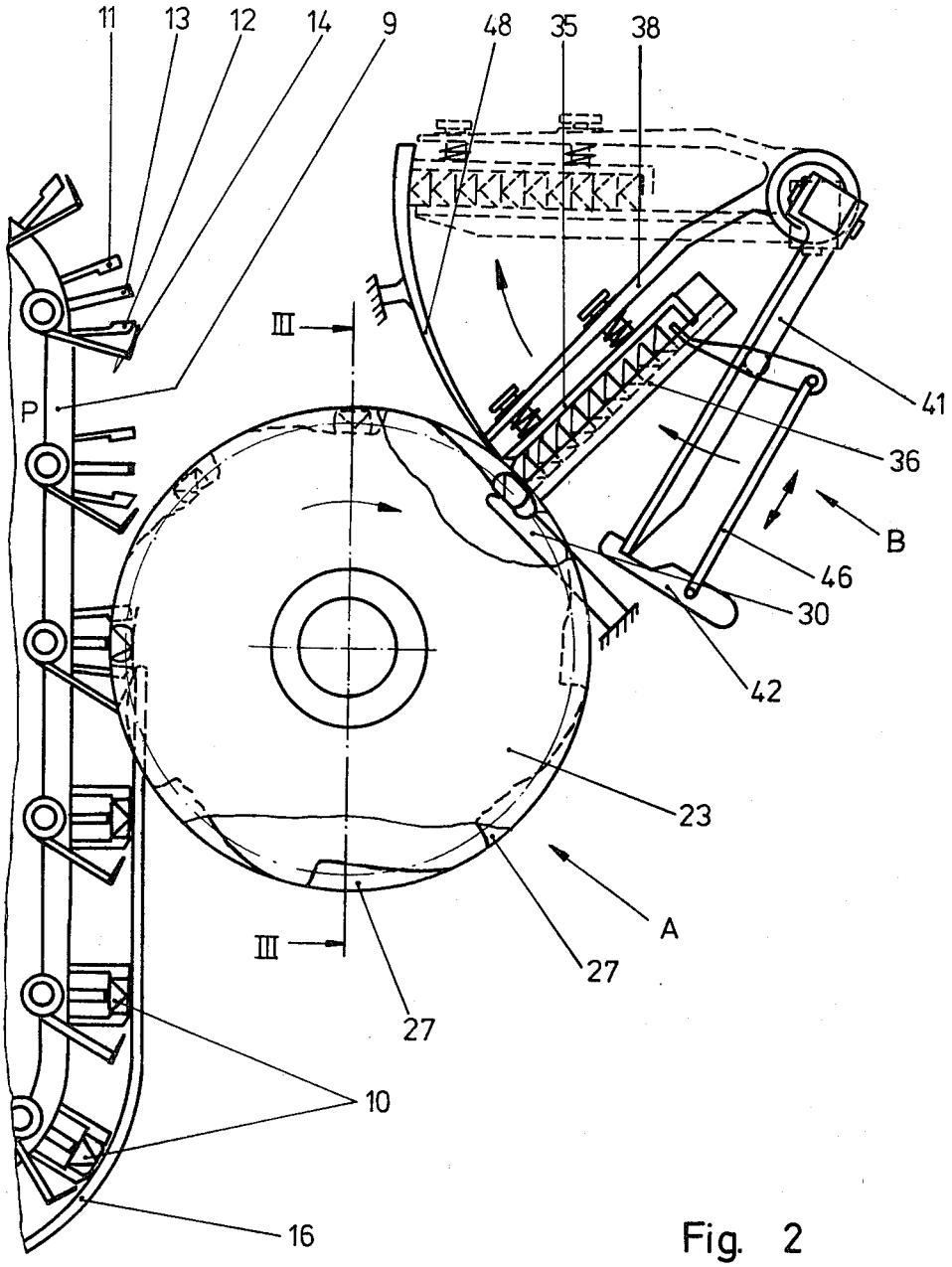
FIG. 2 shows a diagrammatic view of the apparatus according to the invention, for producing bar packages and supplementing the arrangement shown in FIG. 1.
Figure 3:
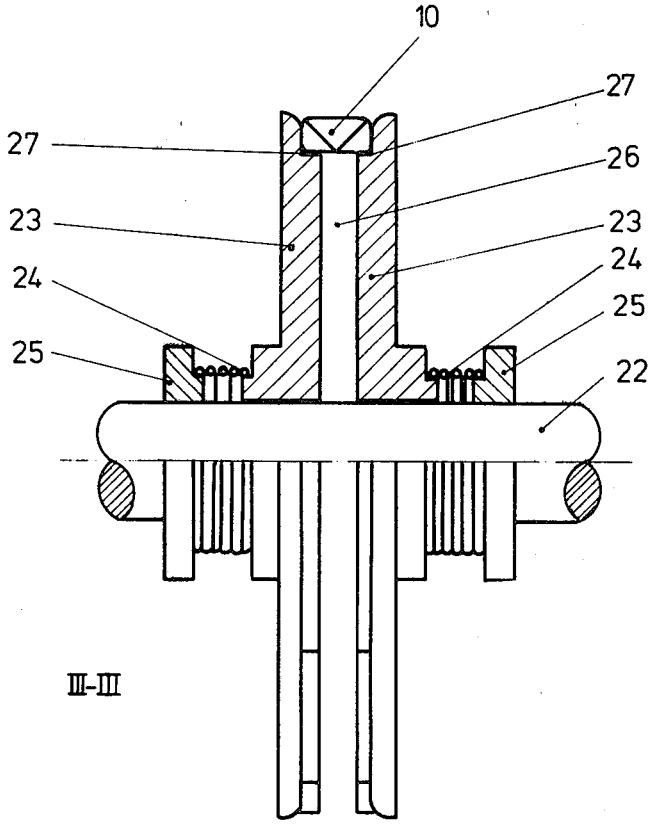
FIG. 3 shows a cross-section taken on the line III—III in FIG. 2.

The sweets holder formed by the discs 23 rotates in the direction of the arrow and is so disposed that the periphery of the discs extends into the working zone or area of movement of the sweets grippers 11, 12 of the packing head, as FIG. 2 shows. The sweets grippers 11, 12 and the sweets holder 23 work in the same working plane and at the same speed of progress, the successive chambers for holding the sweets being spaced on the periphery of the sweets holder at the same interval as the successive sweets grippers of the packing head. In this way, with appropriate controlling of the sweets grippers 11, 12, the individually wrapped sweets 10 are introduced, one after another, into the successive chambers 27 and, after being released by the sweets grippers 11, 12, are gripped firmly between the discs 23 in, in each case, a holding chamber.

Figure 4:
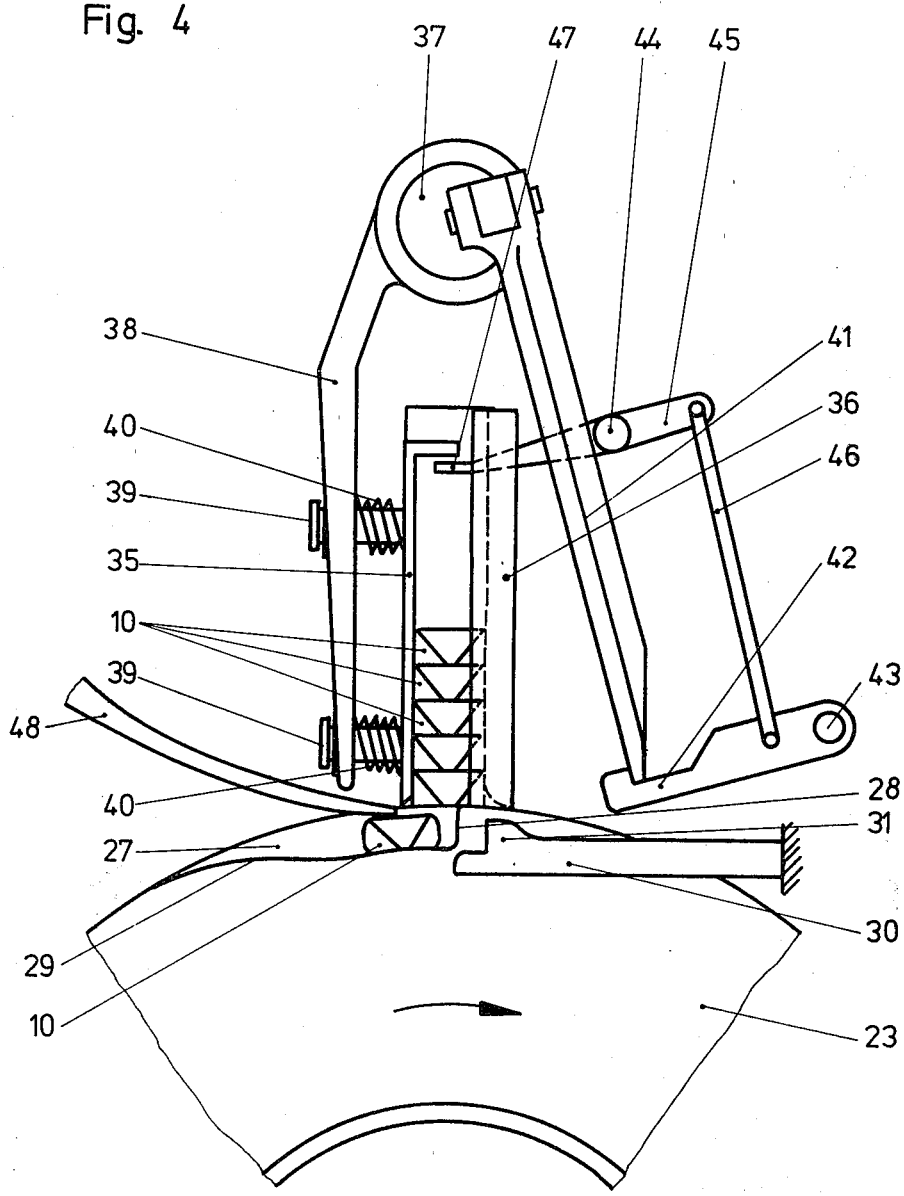
FIGS. 4 to 6 show individual views of the stack former in different working positions.

On the side opposite the packing head, there is a stationary stop 30 which extends into the gap 26 between the two discs 23. The stop 30 is provided with a projection 31 which is struck by the sweets 10 held in the chambers 27, so that, as the discs 23 continue to rotate, the sweets are lifted over the bottom surface 29 which rises towards the other disc periphery 2 out of the chambers of the sweets holder and are, at the same time, pressed into the stack former. FIG. 4 shows the moment when a sweet 10 strikes the stop 30, 31.

Figure 5:
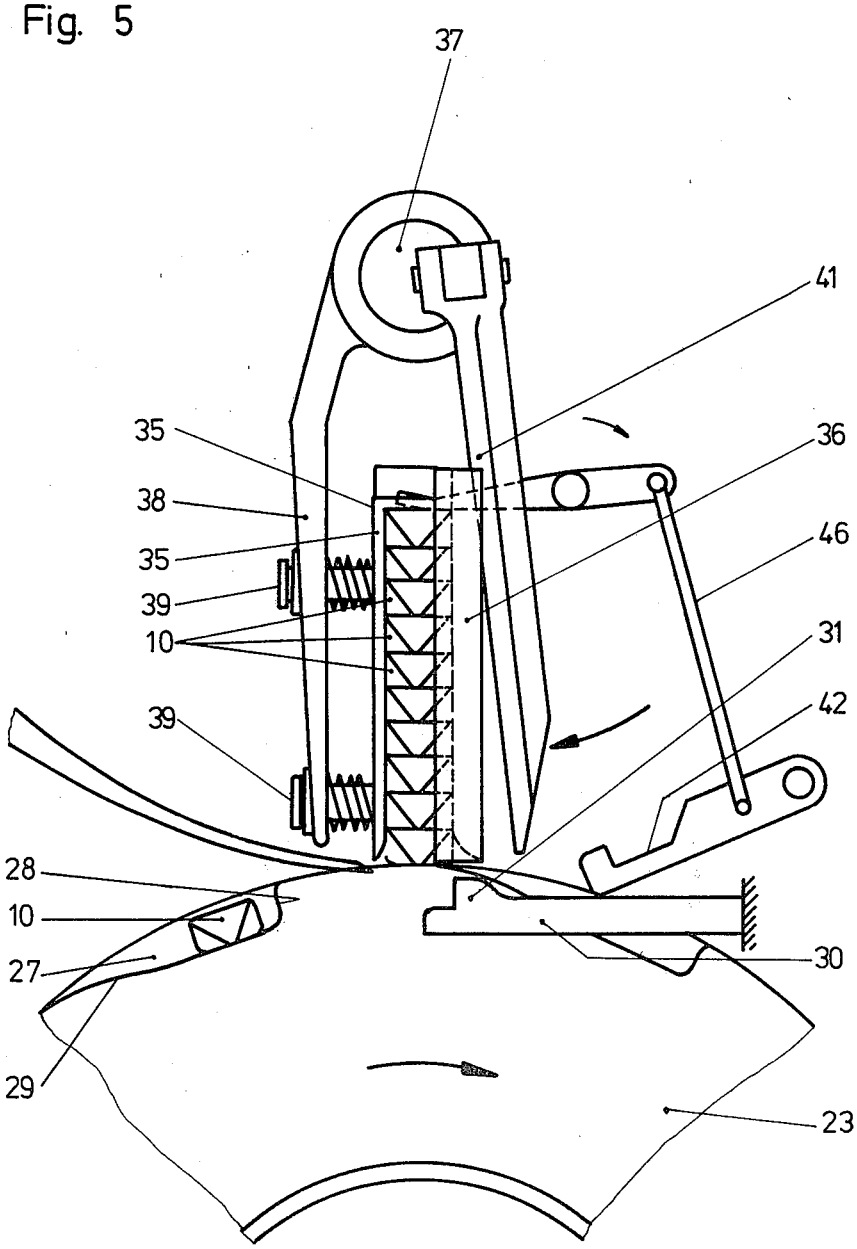
Figure 6:
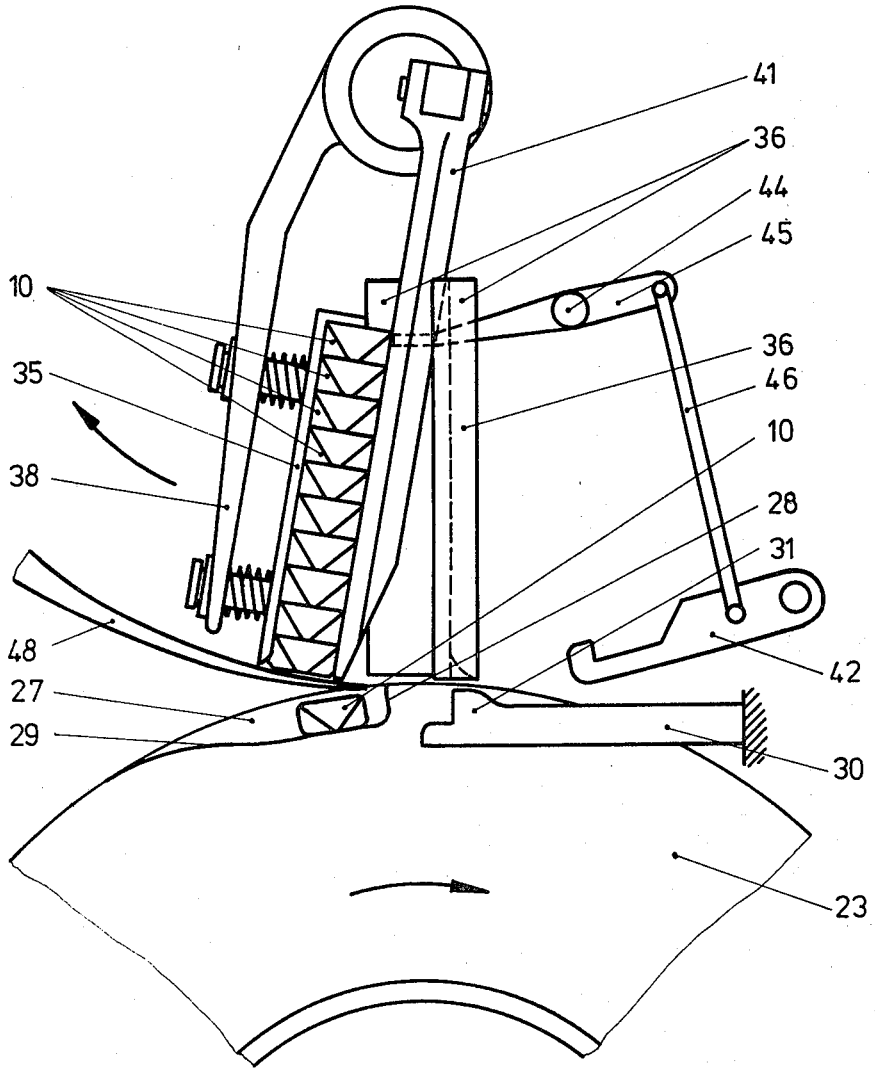
Figure 7:
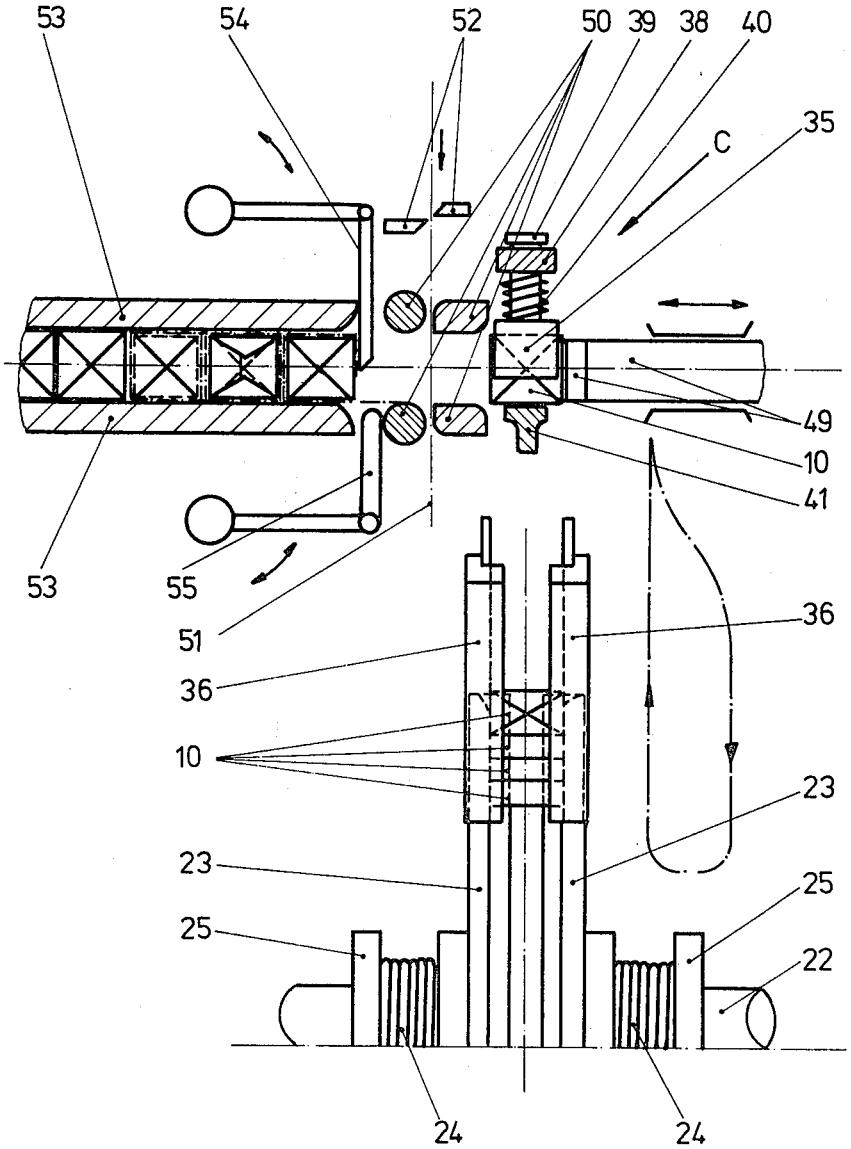
FIG. 7 shows a view of the apparatus in FIG. 2 in the direction of the arrow X.

As FIGS. 4 to 6 show, the stack former lies directly at the place where the sweets 10 are pushed, one after another and more or less in a radial direction, out of the sweets holder 23 at the level of the stop 31.

The stack former consists substantially of a shaft formed by strips 35 and 36 for the sweets 10. A pair of strips 36 extending over the height of the shaft is rigidly disposed, leaving a longitudinal gap between them and being immediately adjacent to the projection 31 of the stop 30. Cooperating with this pair of strips 36 is a counter strip 35 which is carried by a holder 38 oscillating about a pivot 37. Via guide studs 39 and thrust springs 40, this counter strip 35 is so fixed on the holder 38 that the stack formed from sweets 10 is held resiliently firm. The counter strip 35, against which pressure is resiliently applied, prevents sweets 10 from slipping back out of the shaft.

Pivotable about the same pivot axis 37 is a driver 41 which can swing through the gap between the strips 36 while being held, at the free end, by a locking lever 42 pivotable about a fixed axis of rotation 43.

Mounted on a further rigidly mounted axis 44 is an abutment lever 45 which is articulatingly connected by a thrust rod 46 to the locking lever 42, its abutment 47 extending between the strips 36, through into the sweets receiving shaft.

Finally, extending in the peripheral direction of the oscillating holder 38, there is a guide 48 which prevents single sweets slipping out of the shaft again when the stack of sweets is pivoted.

The stack former operates in that the individually wrapped sweets 10, arriving one after another between the discs 23 of the sweets holder, strike the abutment 30 and are pushed from the bottom 29 of the respective chamber into the radially adjacent receiving shaft of the stack former from below. The sweets are held resiliently fast between the guide strips 35 and 36 whereby, with every new sweet, the previously formed stack of sweets is advanced in the shaft by the thickness of the sweet. When the desired number of sweets in the stack is attained, the stack strikes the stop 47 of the lever 45, which, according to FIG. 5, is pivoted in the direction of the arrow. Via the rod 46, the locking lever 42 is released by the driver 41 which now, subjected to spring action or controlled by a controlling device, pivots in the direction of the arrow shown in FIG. 6 through between the guide strips 36 and swings the stack of sweets, together with the stack holder 38, into the position shown by broken lines in FIG. 2. The stack of sweets is thereby supported on the guide 48.

In order to bring any desired number of sweets 10 together in one bar package, the stop 47, which limits the length of the bar, is adjustable.

As soon as the stack former reaches the position indicated by broken lines in FIG. 2, the entire sweet bar is ejected by means of a ram 49 dispaceable transversally of the pivoting movement of the stack former. This process is at the same time utilized for packing the bar of sweets, in that, by means of the ram 49, the bar is pushed transversally in respect of its height through a folding shaft 50, a wrapper blank 51 being thereby placed around the sweets bar. The blank material 51 runs from a stock roll, not shown, to the cutters 52 by which it is cut to the necessary length. After the sweet bar has been pushed into the holding shaft 53, the wrapping material is placed completely around the bar by controlled folding members 54 and 55 and is, at the head ends of the bar, completely sealed by folding means, not shown in greater detail.

In the same way, it is possible also to produce, from a specific number of sweets bars, further collective packages comprising, for example, five or ten bars.

After emptying of the stack former or wrapping of the sweets bar, the levers 38 and 41 can again swing back into their starting position, which is particularly true of the lever 41, the path of movement of which is shown by dash-dotted lines in the forward and reverse directions.

Figure 8:
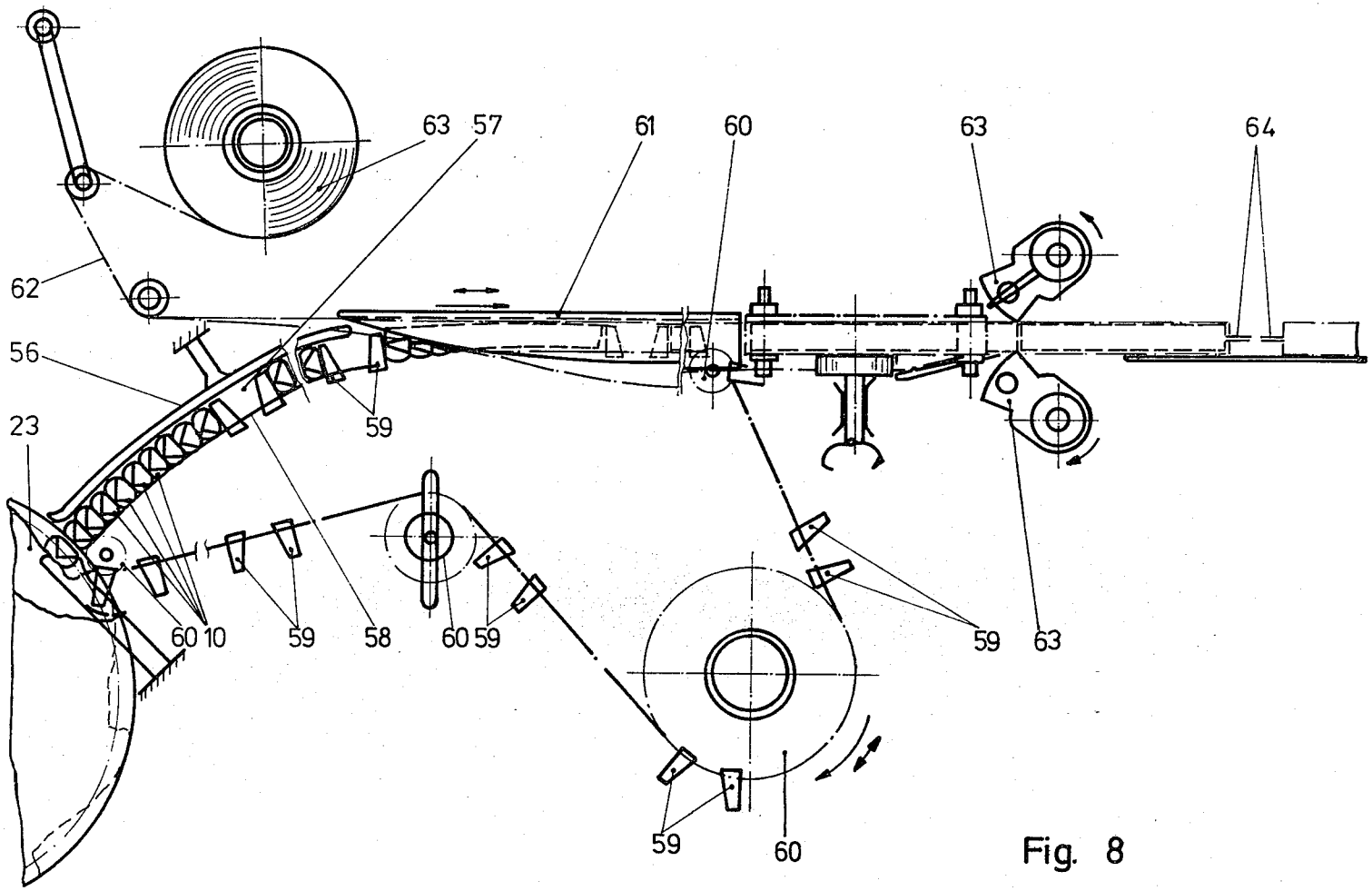
FIG. 8 shows a diagrammatic view of another embodiment of the bar packaging apparatus.
Figure 10:
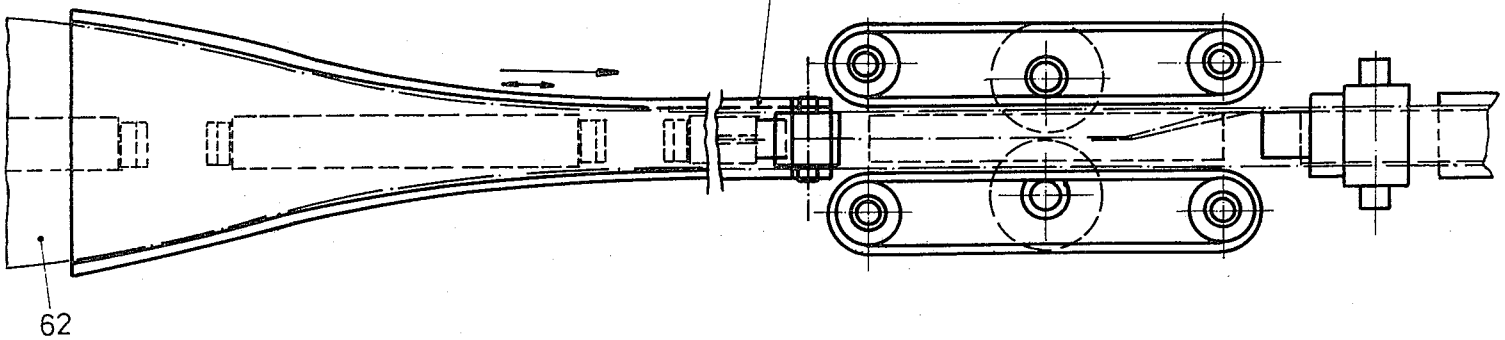
FIG. 10 shows a plan view of the bar packaging apparatus according to FIG. 8.
Figure 9:
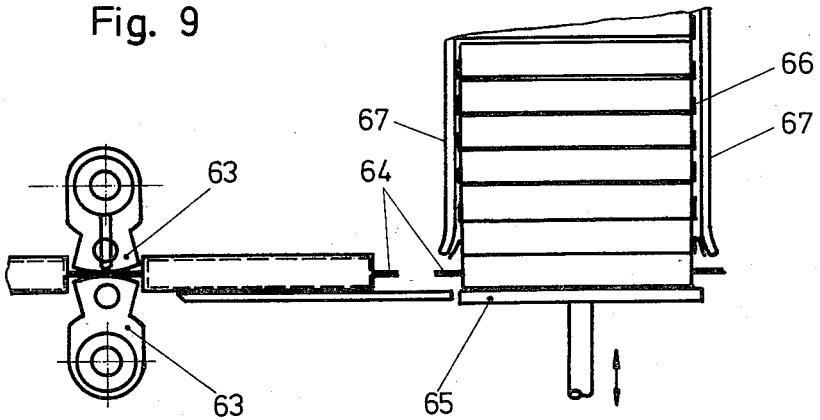
FIG. 9 shows a detail of the bar packaging apparatus according to FIG. 8.

Another embodiment of the apparatus for wrapping a sweets bar is shown in FIGS. 8 to 10. Here a slightly curved guide shaft 56, 57, starting more or less radially from the sweets holder, is used, the said guide shaft being of U-shaped cross-section and having, extending along its open side, a cnveyor belt 58 or a chain or the like on which there are spacers 59 which, in their distance from one another, are adjustable according to the size of the bars of sweets to be packed. The conveyor belt 58 runs over guide and drive rollers 60 and, together with the shaft 56, is adjacent to the point at which the sweets are ejected from the sweets holder 23.

The speed of revolution of the belt 58 and the adjusted spacing of the drivers 59 are so chosen that a definite adjustable number of sweets intended to form a bar are always entrained in the conveyor shaft 56. Adjacent to the end of the collecting shaft 56, 57 is a format 61 through which the sweets bars are passed by the conveyor belt 60, and in fact simultaneously with a web 62 of a suitable wrapping material which runs off a reel 63. In the format 61, the wrapping material, for example a plastics film of tubular shape, is placed around the successive bars of sweets, the protruding tube edges being joined to one another by welding. Between consecutive bars of sweets in the tube, revolving, parting and welding members 63 form gaps and make welds 64, so that the individual bars are enclosed in wrapping material and can be separated from one another.

We claim:

1. Apparatus for producing bar-shaped packages from preferably individually wrapped pieces of candy or similar confections, comprising: a continuously revolving packing head; candy pickups and wrapping-material folders mounted on said continuously revolving packing head for wrapping said candy pieces; feeder means for supplying said candy grippers and folders with pieces of candy; transfer means and stacker means, said transfer means transferring pieces of candy from said pickups to said stacker means; stack packaging means for wrapping stacks of candy formed in the stacker means in an outer wrapping; said transfer means having two disks rotating constantly on a common axis, said disks having outward-opening recesses on the periphery of their facing sides, said recesses being as deep radially as a piece of candy is thick, said recesses comprising holding chambers for the candy, each chamber comprising radial walls formed by said disks and extending parallel to the direction of rotation and a chamber bottom merging gradually into the periphery of the disk in a direction opposite to the direction of rotation of the disk; spring means for pressing said disks against each other axially so that said holding chambers grasp pieces of candy between them and move them to said stacker means; stationary stop means located near said stacker means and between said disks for transferring a piece of candy, as it is carried along in a chamber revolving between the disks, radially, outwardly along the sloping bottom of the diameter into said stacker means; so that a plurality of individually wrapped pieces of candy are positioned in a stack in sequence along the longitudinal axis of the bar-shaped package and wrapped together in one package with an outer wrapping.

2. Apparatus as defined in claim 1, wherein said chambers for holding the pieces of candy are distributed at the same interval as said candy pickups on said packaging head along the periphery of said disks, said disks comprising a candy receiver.

3. Apparatus as defined in claim 2, wherein said disks comprising said candy receiver are exchangeable with other disks to handle different-sized pieces of candy.

4. Apparatus as defined in claim 3, wherein said candy receiver rotates in the same operational plane as said packaging head and extends into the path of the candy pickup to the depth of said holding chambers.

5. Apparatus as defined in claim 1, wherein said stacker means comprises a stacking shaft accepting the pieces of candy in sequence and being positioned radially from said candy receiver, said stacking shaft being adjustable to accept various amounts of the candy to be packaged or stacks of various height and being connected to a conveyor leading to a stack packager.

6. Apparatus as defined in claim 5, wherein said conveyor operates parallel to the stacking shaft.

7. Apparatus as defined in claim 1, wherein said chambers for holding the pieces of candy are distributed at the same interval as said candy pickups on said packaging head along the periphery of said disks, said disks comprising a candy receiver said disks comprising said candy receiver being exchangeable with other disks to handle different-sized pieces of candy; said candy receiver rotating in the same operational plane as said packaging head and extending into the path of the candy pickup to the depth of said holding chambers; said stacker means comprising a stacking shaft accepting the pieces of candy in sequence and being positioned radially from said candy receiver, said stacking shaft being adjustable to accept various amounts of the candy to be packaged or stacks of various height and being connected to a conveyor leading to a stack packager.

* * * * *